US006367175B2

(12) United States Patent
Lewis et al.

(10) Patent No.: US 6,367,175 B2
(45) Date of Patent: Apr. 9, 2002

(54) LOW TURBULENCE AIR BLAST SYSTEM

(75) Inventors: Scott Lewis, Lakewood; Mike Weege, Evergreen; Greg Noah, Denver, all of CO (US)

(73) Assignee: S&S Trust, Commerce City, CO (US)

( * ) Notice: Subject to any disclaimer, the term of this patent is extended or adjusted under 35 U.S.C. 154(b) by 0 days.

(21) Appl. No.: 09/840,247

(22) Filed: Apr. 23, 2001

Related U.S. Application Data

(60) Provisional application No. 60/199,053, filed on Apr. 22, 2000.

(51) Int. Cl.[7] ..... E01H 5/12; A47L 5/00

(52) U.S. Cl. ..... 37/202; 15/405

(58) Field of Search ..... 37/196, 202, 905; 15/340.1, 405, 409

(56) References Cited

U.S. PATENT DOCUMENTS 3,099,097 A * 7/1963 Simmons ..... 37/202

5,515,623 A * 5/1996 Weeks ..... 37/227

* cited by examiner

*Primary Examiner*—Christopher J. Novosad
(74) *Attorney, Agent, or Firm*—Jenkens & Gilchrist, A Professional Corporation

(57) ABSTRACT

The invention relates to an apparatus and method for directing a low turbulence vehicle-mounted air blast for use in clearing snow or debris from a road or runway. An air blast system is mounted in the central portion of the vehicle underneath the chassis. An air duct is positioned on either side of the truck adjacent to a channel which passes under the truck. The air ducts are designed with minimal curvature and internal baffles in order to minimize air flow turbulence. During operation, the channel and air duct are lowered toward the ground and high velocity air passes through the channel. A vacuum is created which draws snow or debris from the runway, out of the air duct, and away from the truck. When turnaround is required at the end of a runway, the operator simply lifts the air duct currently in operation and lowers the air duct on the other side of the truck.

18 Claims, 6 Drawing Sheets

LOW TURBULENCE AIR BLAST SYSTEM

This application claims the benefit under Title 35 United States Code §119(e) of U.S. Provisional Application No. 60/199,053, filed Apr. 22, 2000.

BACKGROUND OF THE INVENTION

1. Technical Field

This invention relates generally to a method and apparatus for directing a snow or debris blowing air blast under vehicles. More particularly, this invention relates to an apparatus and method for directing a low turbulence vehicle-mounted air blast for use in clearing snow or debris from a road or runway.

2. History of Related Art

Vehicle-mounted devices for use in clearing snow or debris from a road or runway typically include a front-mounted broom assembly and a rear-mounted air blast system as shown in FIG. 1. Alternatively, some prior art air blast systems are mounted between the front and rear axles. As the truck moves down the runway, the spinning broom on the front of the truck contacts the snow or debris on the runway and brushes the snow or debris both to the front and to one side. Then the snow or debris which has been swept to one side is blown farther across the runway by the air blast system.

As may be seen in FIG. 1, when it is desired to push the snow or debris to one side of the runway, specifically the left side as shown in the figure, the truck moves along the right side of the runway until it reaches the end. Upon reaching the end of the runway, the operator must re-configure the truck by repositioning the broom and redirecting the air blast. Note that in the truck moving up the runway on the right side of FIG. 1, the broom is positioned so that the near end is closest to the left or driver side of the truck going up the runway and the air blast is exiting the truck on the left side.

This switching of the direction of the air blast system and the changing of the angular orientation of the broom keeps the snow or debris moving from the right side of the runway to the left side of the runway. In one prior art configuration, the direction of the air blast at the rear end of the truck is controlled by the use of two multi-curved air ducts mounted on either side of the truck. These bends in the air ducts induce unwanted turbulence into the high velocity air flow. When it is desired to push the snow or debris to the right side of the truck, the air duct on the left side at the rear of the truck comes down and the air blast system causes high velocity air to pass from the left side to the right side of the truck to blow the snow or debris in the same direction that it is pushed by the broom.

Alternatively, some prior art air blast systems use an air duct with vanes to regulate the flow of air to the left or right depending on the direction that the broom is facing. The vanes are switched in order to change the direction of air flow from one side of the truck to the other. In this configuration, the air blast is split in two, with only half of the air flow going to the left or right.

When the truck comes to the end of the runway in prior art systems, the orientation of the broom and the direction of the air blast system are both reconfigured for another pass in the opposite direction down the runway. This reconfiguration of the truck for the second pass down the runway begins by first changing the direction of the air flow in the air blast system from one side to the other by repositioning the ducts or vanes. Following this repositioning, the broom in the front of the truck is repositioned. Thus, in prior art systems, the truck turnaround and reconfiguration time is a problem. Moreover, in the prior art configuration that utilizes vanes, the system is less efficient due to the reduction of air flow and decreased air speed.

While it is intended that the front mounted rotating broom remove most of the snow or debris from the runway and the air blast system both blow the loose snow or debris to one side and dry the surface of the runway, in actual practice it has been found that the broom does not remove all the snow from the surface of the runway. Moreover, in those prior art systems which have the air blast system at the rear of the truck, the snow remaining on the runway is compacted by the rear wheels of the truck before it is impacted by the high velocity air from the air blast system. Additionally, in those prior art systems with air ducts vanes, even if the system is mounted between the front and rear axles, the force of air flow is not powerful enough to remove all the snow from the surface of the runway.

What is needed is a vehicle-mounted air blast system which eliminates the need for reconfiguration of the air ducts whenever the vehicle turns around. Additionally, the air blast system should be positioned on the truck such that the blast of air moves the snow or debris from under the truck before it is compacted by the truck wheels. The air ducts of the air blast system should be designed to minimize air turbulence and allow the air ducts to be pulled up under the truck when not in use. Finally, the air blast system should be configured to create a powerful and efficient air flow which also operates as a vacuum to suction as much snow as possible from the surface of the runway.

SUMMARY OF THE INVENTION

The present invention is an apparatus and method for directing a low turbulence vehicle-mounted air blast for use in clearing snow or debris from a road or runway. The high velocity air passes through the air ducts into the channel which passes under the central portion of the truck. The air flow is not split in half, but is delivered in a single blast which powerfully blows the snow across the runway. Additionally, the passage of the high velocity air through the channel creates a vacuum which efficiently draws the snow and moisture off the runway surface and removes the snow from cracks in the runway. FIG. 5 illustrates the air duct on the left side of the truck engaging the channel passing under the central portion of the truck to provide an air blast exiting on the right side of the truck.

The turbulence of the air flow in the air blast system is minimized by the reduction in the amount and severity of the bends in the air ducts as compared to those used in prior art trucks. Additionally, internal baffles within the air ducts are used to further reduce the air flow turbulence. The air channel and air ducts are lowered toward the ground during operation. To eliminate the problem of the rear wheels compressing the snow on the runway, the air blast system has been moved to the central portion of the truck just behind the driver's cab. As may be seen in FIG. 5, the air duct on the left side of the truck is positioned adjacent to an air channel which passes under the truck. This positioning of the air blast system in front of the rear wheels also enables a better weight distribution on the truck.

When the truck reaches the end of the runway, the air duct currently in use is lifted and the other air duct is lowered. In this way, the operation is without interruption and the blast of snow or debris is sent to the same side of the runway upon turnaround. When the air blast system is not in use and the truck is prepared for road travel, both the air ducts and the channel may be pulled up under the chassis of the truck as shown in FIG. 4 and FIG. 7.

BRIEF DESCRIPTION OF THE DRAWING FIGURES

A more complete understanding of the structure and operation of the present invention may be had by reference to the following detailed description when read in conjunction with the accompanying drawings, wherein.

DETAILED DESCRIPTION OF THE PRESENTLY PREFERRED EXEMPLARY EMBODIMENT

Figure 1:
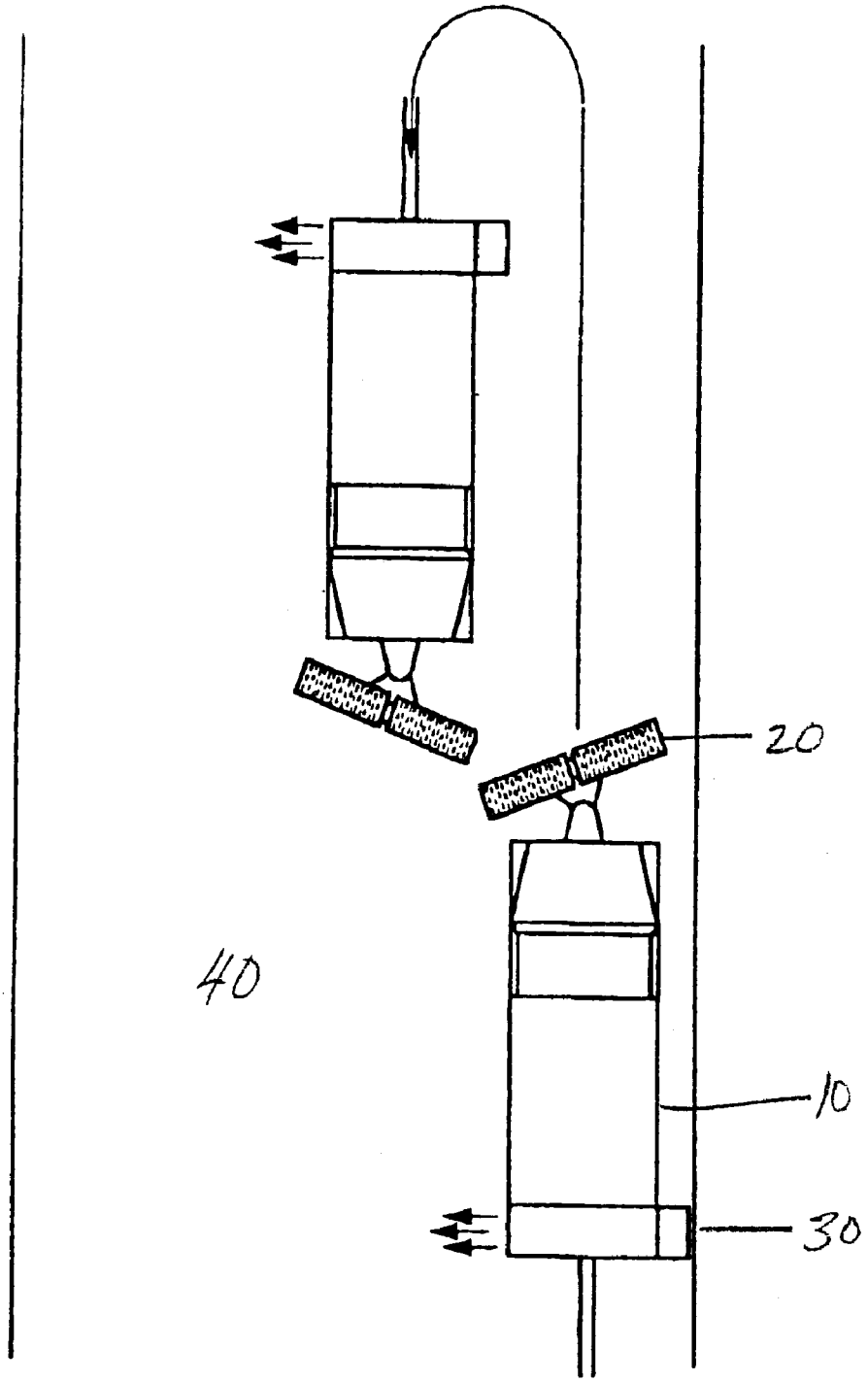
Fig. 1 (PRIOR ART)
FIG. 1 is a diagram illustrating the configuration of a truck mounted broom and air blast system in the prior art.

A still better understanding of the apparatus and method for of the present invention may be had by reference to the Drawing Figures. FIG. 1 illustrates the configuration of a truck mounted broom and air blast system in the prior art. The vehicle 10 in FIG. 1 is shown proceeding up the runway 40 with the broom assembly 20 and air blast system 30 configured for directing the snow or debris to the left side of the vehicle 10 and the left side of the runway 40. When the vehicle 10 reaches the end of the runway 40, the operator must reconfigure the broom assembly 20 and air blast system 30 to the right side of the vehicle 10 such that the snow or debris is still directed to the left side of the runway 40.

Figure 2:
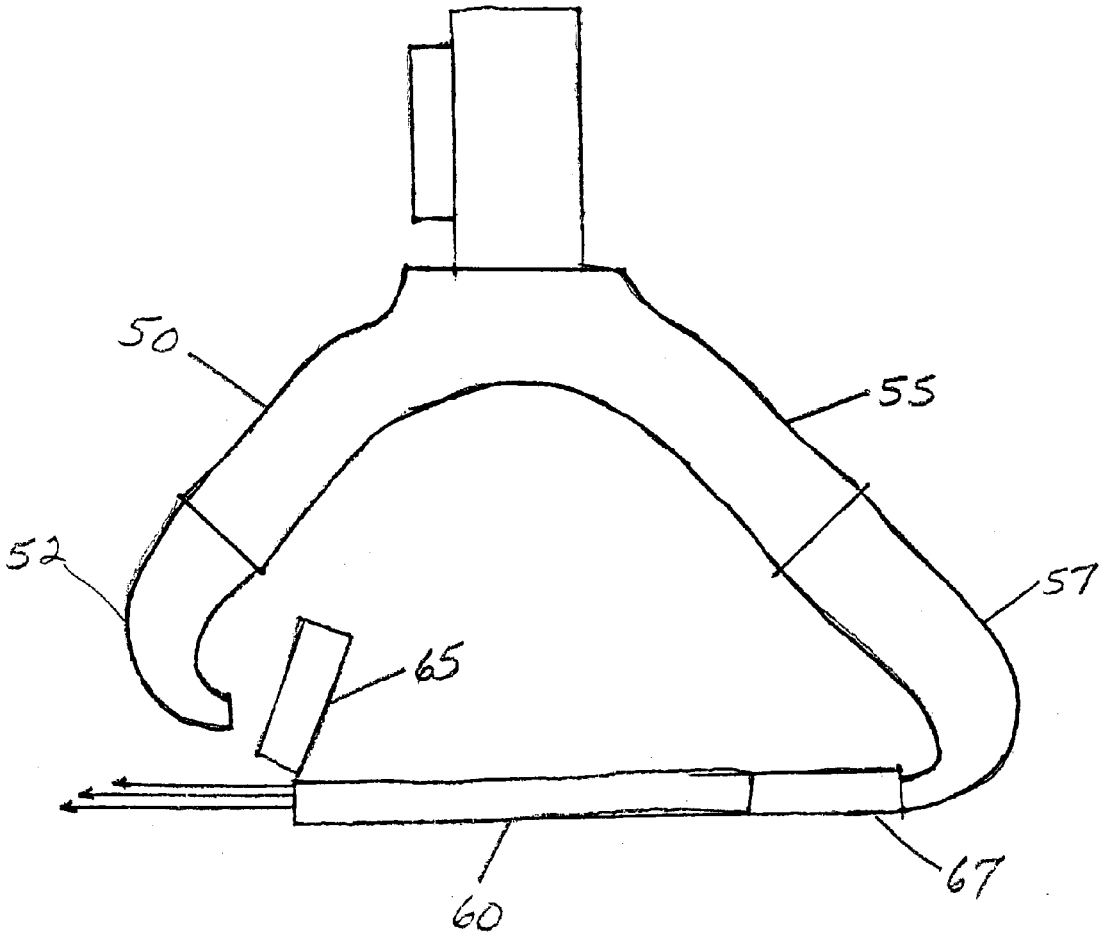
FIG. 2 is a schematic diagram of the air blast system of the present invention configured for left-sided air blast.
Figure 3:
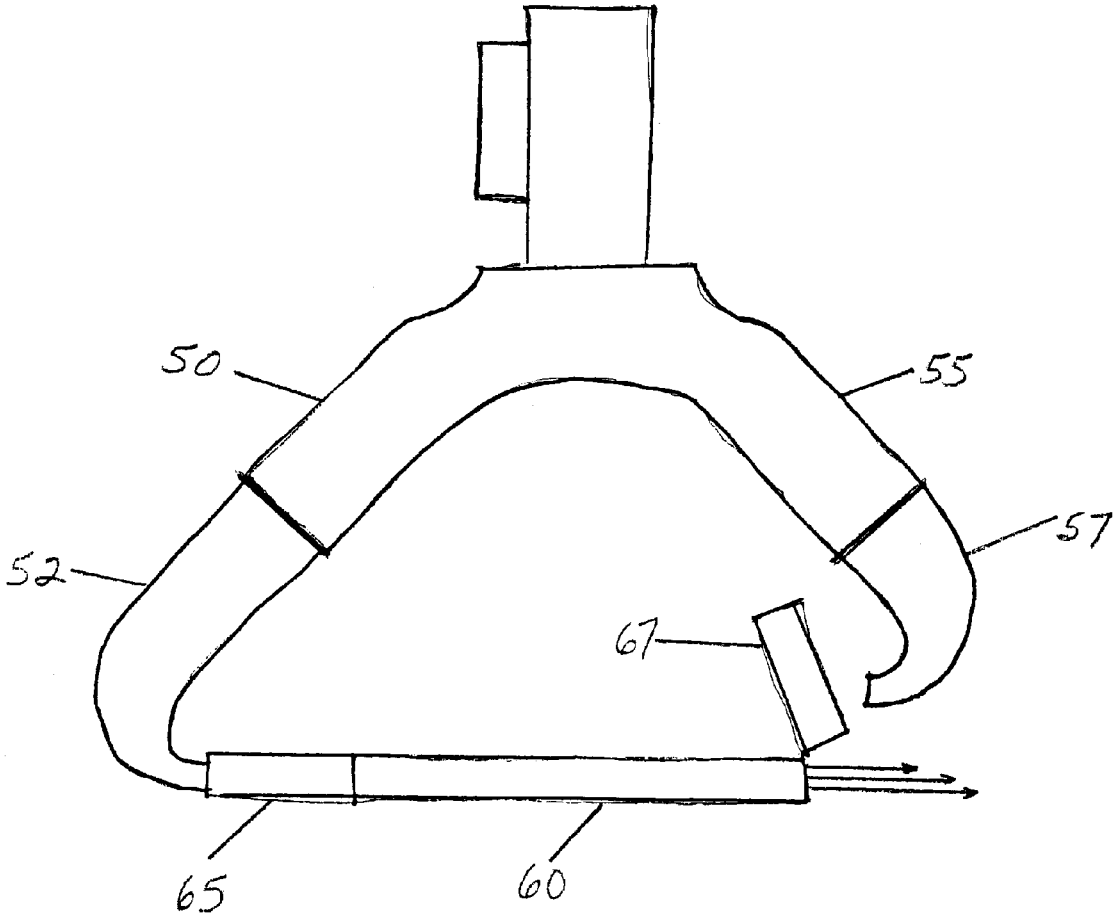
FIG. 3 is a diagram of the air blast system of the present invention configured for right-sided air blast.

In the present invention, as shown in FIG. 2, the operator has the retractable arcuate right air duct 57 fully extended from the right air duct 55 for engagement with the right air channel duct 67 in order to have the snow or debris directed to the left side of the runway. When the vehicle reaches the end of the runway in the present invention, the operator simply disengages the retractable arcuate right air duct 57 from the right air channel duct 67 and retracts the retractable arcuate right air duct 57 and raises the right air channel duct 67. The operator then extends the retractable arcuate left air duct 52 from the left air duct 50, and engages the retractable arcuate left air duct 52 with the left air channel duct 65 as shown in FIG. 3. Thus, the flow of snow or debris exits the right side of the vehicle and is still directed to the left side of the runway.

Figure 4:
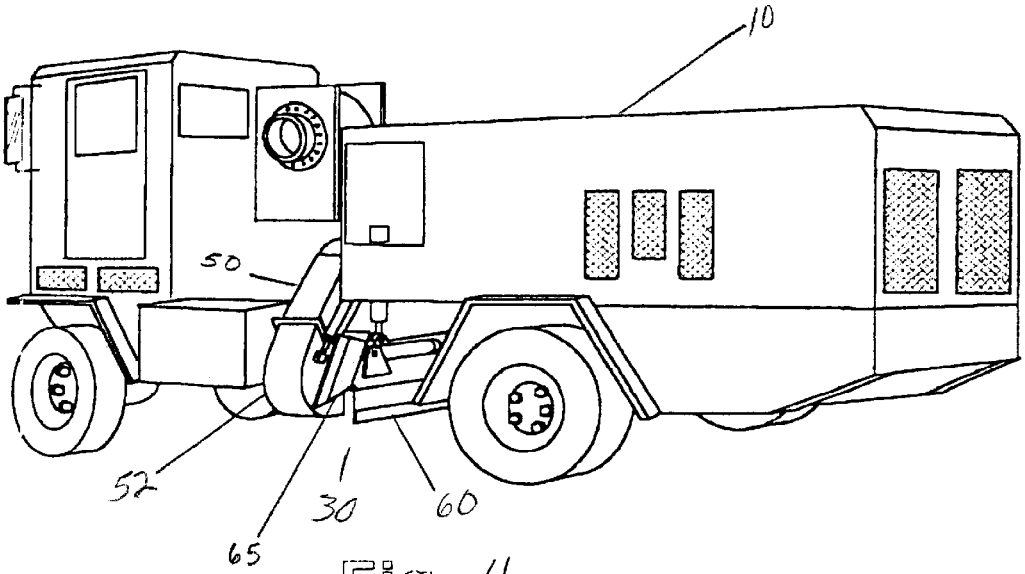
FIG. 4 illustrates a lateral perspective view of the vehicle mounted air blast system of the present invention drawn upwardly for road travel.
Figure 5:
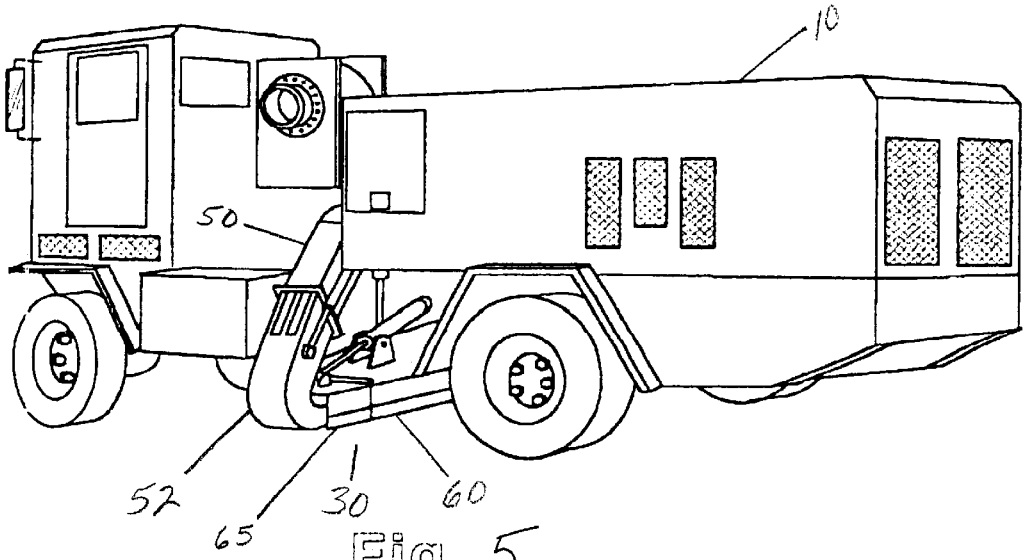
FIG. 5 illustrates a lateral perspective view of the vehicle mounted air blast system of the present invention engaged for operation.

FIG. 4 illustrates a lateral perspective view of the vehicle mounted air blast system of the present invention withdrawn for road travel. The retractable arcuate left air duct 52 is shown retracted into the left air duct 50. The left air channel duct 65 is raised toward the vehicle 10 and the air channel 60 is pulled up toward the chassis of the truck. In FIG. 5, the air blast system of the present invention is illustrated while engaged for operation. The left air channel duct 65 has been lowered into position to receive the retractable arcuate left air duct 52 and to connect with the left end of the air channel 60.

Figure 6:
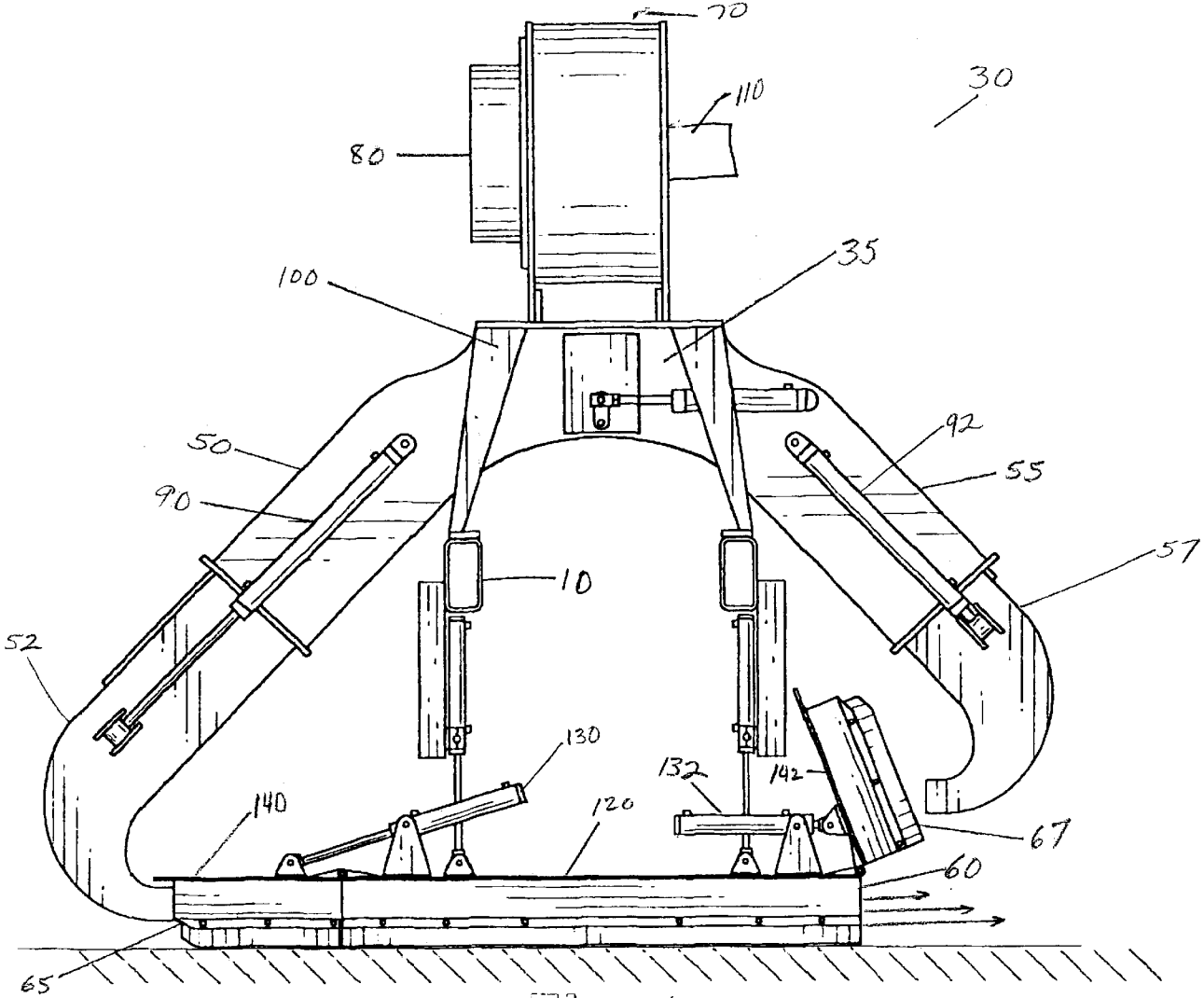
FIG. 6 illustrates a lateral perspective view of the air blast system with the left air duct engaged with the left air channel duct.

FIG. 6 illustrates a lateral perspective view of the air blast system 30 with the retractable arcuate left air duct 52 engaged with the left air channel duct 65. The blower assembly 70 of the air blast system 30 has a motor 110 internally mounted on one side of the blower assembly 70 with a screen 80 located opposite the motor 110. The blower assembly 70 is held in place on the vehicle 10 by the blower mount weldment 100. The blower assembly 70 accelerates the air flow into a plenum chamber 35. The left air duct 50 and right air duct 55 are connected to either side of the plenum chamber 35. The left air duct 50 is connected to the retractable arcuate left air duct 52, and the right air duct 55 is connected to the retractable arcuate right air duct 57.

The air channel 60 is attached to the channel weldment 120. The left and right air channel ducts 65 and 67 are attached to the left and right channel duct weldments 140 and 142. The left and right channel duct weldments 140 and 142 are hingedly attached to the channel weldment 120 at either end. The channel duct hydraulic cylinders 130 and 132 operate to raise and lower the left and right air channel ducts 65 and 67. In FIG. 6, the air blast system 30 is illustrated with the retractable arcuate left air duct 52 extended and engaged with the left air channel duct 65. Thus, the accelerated airflow would travel from the blower assembly 70 through the plenum chamber 35, through the left air duct 50 and the retractable arcuate left air duct 52. The air flow would continue through the left air channel duct 65 and air channel 60 to exit on the right side of the air channel 60. Baffles, well known to those of ordinary skill in the art, are included within the ducts to minimize turbulence.

Figure 7:
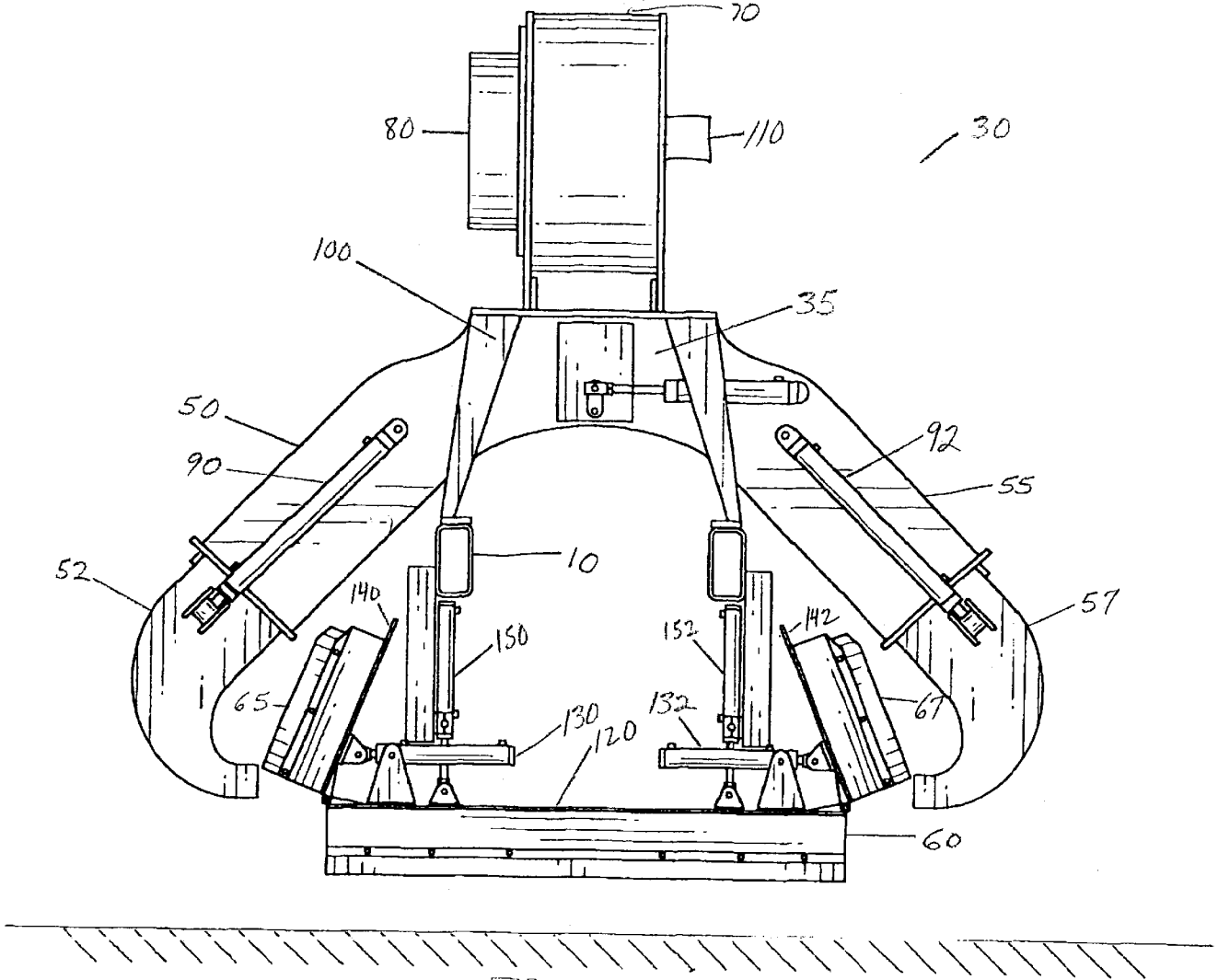
FIG. 7 is a lateral perspective view of the air blast system with the air ducts and air channel withdrawn for road travel.

FIG. 7 is a lateral perspective view of the air blast system 30 with the retractable arcuate air ducts 52 and 57, left and right air channel ducts 65 and 67, and air channel 60 withdrawn for road travel. The retractable arcuate left air duct 52 and the retractable arcuate right air duct 57 are retracted into the left air duct 50 and right air duct 55 by the left and right air duct hydraulic cylinders 90 and 92 respectively. The left and right air channel ducts 65 and 67 are lifted by the left and right channel duct hydraulic cylinders 130 and 132, respectively, and are shown in raised position in FIG. 7. Likewise, the air channel 60 is lifted toward the chassis of the vehicle 10 by the air channel hydraulic cylinders 150 and 152 in preparation for road travel.

Although the invention has been described with reference to specific embodiments, this description is not meant to be construed in a limited sense. The various modifications of the disclosed embodiments, as well as alternative embodiments of the invention, will become apparent to persons skilled in the art upon reference to the description of the invention. It is, therefore, contemplated that the appended claims will cover such modifications that fall within the scope of the invention, or their equivalents.

What is claimed is:

1. A vehicle mounted air blast system comprising:

means for accelerating the velocity of air flow;

a channel member having a first end and a second end, said channel member being constructed and arranged to be mounted substantially perpendicular to the movement direction of the vehicle, under the central portion of the vehicle and having its sides oriented downward;

a first arcuate air duct hingedly mounted to temporarily connect said means for accelerating the velocity of air flow to said first end of said channel;

a second arcuate air duct hingedly mounted to temporarily connect said means for accelerating the velocity of air flow to said second end of said channel;

whereby air is caused to flow under the vehicle in a first direction by the engagement of said first arcuate air duct with said first end of said channel and air is caused to flow under the vehicle in a second direction by the engagement of said second arcuate air duct with said second end of said channel.

2. The vehicle mounted air blast system as defined in claim 1 wherein said channel is vertically positionable.

3. The vehicle mounted air blast system as defined in claim 2 wherein the lowermost range of said vertical positions of said channel with respect to the surface upon which the vehicle is travelling will provide a vacuum for removing debris from the surface on which the vehicle is travelling.

4. The vehicle mounted air blast system as defined in claim 2 wherein the uppermost range of said vertical positions of said channel with respect to the surface upon which the vehicle is travelling will protect said channel from damage when in a transport mode.

5. The vehicle mounted air blast system as defined in claim 1 wherein said first and second end of said channel include channel extensions hingedly mounted thereto.

6. The vehicle mounted air blast system as defined in claim 1 wherein said sides of said channel member include flexible extensions.

7. The vehicle mounted air blast system as defined in claim 1 wherein said first arcuate air duct and said second arcuate air duct each contain at least one internal baffle.

8. A system for blowing unwanted debris from the surface of a road or a runway, said system comprising:

a vehicle having a front end, a back end and a central portion therebetween;

means for accelerating the velocity of an air flow mounted on said vehicle;

a channel member having a first end and a second end, said channel member being constructed and arranged to be mounted substantially perpendicular to the movement direction of the vehicle, under the central portion of the vehicle and having its sides oriented downward;

a first arcuate air duct hingedly mounted to temporarily connect said means for accelerating the velocity of air flow to said first end of said channel;

a second arcuate air duct hingedly mounted to temporarily connect said means for accelerating the velocity of air flow to said second end of said channel;

whereby air is caused to flow under the vehicle in a first direction by the engagement of said first arcuate air duct with said first end of said channel and air is caused to flow under the vehicle in a second direction by the engagement of said second arcuate air duct with said second end of said channel.

9. The vehicle mounted air blast system as defined in claim 8 wherein said channel is vertically positionable.

10. The vehicle mounted air blast system as defined in claim 9 wherein the lowermost range of said vertical positions of said channel with respect to the surface upon which the vehicle is travelling will provide a vacuum for removing debris from the surface on which the vehicle is travelling.

11. The vehicle mounted air blast system as defined in claim 9 wherein the uppermost range of said vertical positions of said channel with respect to the surface upon which the vehicle is travelling will protect said channel from damage when in a transport mode.

12. The vehicle mounted air blast system as defined in claim 8 wherein said first and second end of said channel include channel extensions hingedly mounted thereto.

13. The vehicle mounted air blast system as defined in claim 8 wherein said sides of said channel member include flexible extensions.

14. The vehicle mounted air blast system as defined in claim 8 wherein said first arcuate air duct and said second arcuate air duct each include at least one internal baffle.

15. A method for directing a debris blowing air blast under a vehicle, said method comprising the steps of:

mounting a channel having a first end and a second end under the central portion of the vehicle substantially perpendicular to the direction of motion of the vehicle;

mounting means for accelerating an air flow to the vehicle;

hingedly mounting a first air duct between said means for accelerating an air flow and said first end of said channel;

hingedly mounting a second air duct between said means for accelerating an air flow and said second end of said channel;

whereby debris may be blown to a first side of the vehicle by moving said first air duct into contact with said first end of said channel and debris may be blown to a second side of the vehicle by moving said second air duct into contact with said second end of said channel.

16. The method for directing a debris blowing air blast under a vehicle as defined in claim 15 further including the step of attaching at least one internal baffle to said first air duct and said second air duct.

17. A vehicle mounted air blast system comprising:

a blower for accelerating air flow;

a plenum chamber having a first leg and a second leg mounted to said blower;

means for directing air flow through either said first leg or said second leg of said plenum chamber;

a channel member constructed and arranged to pass under said vehicle substantially perpendicular to the operational direction of the vehicle a first air duct hingedly mounted to said first leg of said plenum chamber;

a second air duct hingedly mounted to said second leg of said plenum chamber;

means for moving said first air duct from a position out of contact with said channel member to a position in contact with said first end of said channel member;

means for moving said second air duct from a position out of contact with said channel member to a position in contact with said second end of said channel member;

whereby air from said blower may be caused to pass through said first leg of said plenum chamber, said first air duct and through said channel in a first direction when said first air duct is in contact with said first end of said channel and in a second direction when said second air duct is in contact with said second end of said channel.

18. The vehicle mounted air blast system defined in claim 17 further including at least one internal baffle in said first air duct and said second air duct.

* * * * *